US007032837B2

(12) United States Patent
Eddins et al.

(10) Patent No.: US 7,032,837 B2
(45) Date of Patent: Apr. 25, 2006

(54) TOY WATER GUN WITH VARIABLE SPRAY PATTERNS

(75) Inventors: Fred Daniel Eddins, Mapleville, RI (US); Robert L. Brown, North Kingstown, RI (US)

(73) Assignee: Hasbro Inc., Pawtucket, RI (US)

( * ) Notice: Subject to any disclaimer, the term of this patent is extended or adjusted under 35 U.S.C. 154(b) by 107 days.

(21) Appl. No.: 10/773,979

(22) Filed: Feb. 6, 2004

(65) Prior Publication Data

US 2005/0173559 A1 Aug. 11, 2005

(51) Int. Cl.
*B05B 3/00* (2006.01)

(52) U.S. Cl. ..... 239/255; 239/253; 239/254; 222/79; 222/1; 222/78; 74/25

(58) Field of Classification Search ..... 74/25; 222/79, 255, 275, 271; 446/473; 239/263.2, 239/263.3, 240, 249, 210, 263
See application file for complete search history.

(56) References Cited

U.S. PATENT DOCUMENTS 2,875,553 A * 3/1959 Morgan ..... 446/243
3,481,346 A 12/1969 McBurnett
4,651,925 A * 3/1987 Harris ..... 239/239
4,744,517 A * 5/1988 Iwamoto et al. ..... 239/263
4,821,961 A * 4/1989 Shook ..... 239/253
4,895,307 A * 1/1990 Swinehart et al. ..... 239/263
5,439,139 A 8/1995 Brovelli
5,730,325 A * 3/1998 Cheung ..... 222/79
6,059,202 A * 5/2000 Zink et al. ..... 239/259
6,138,871 A * 10/2000 D'Andrade ..... 222/79

* cited by examiner

*Primary Examiner*—David A. Scherbel
*Assistant Examiner*—James S. Hogan
(74) *Attorney, Agent, or Firm*—Marshall, Gerstein & Borun LLP

(57) ABSTRACT

A toy water gun of the type for ejecting fluid therefrom. The toy water gun may include a housing having a longitudinal axis and a reservoir attached to the housing for holding fluid. A holding area may be included which is selectively in fluid communication with the reservoir. A pump may be provided for generating pressure differential across a pair of one-way valves to move fluid from the reservoir to the holding area and from the holding area to at least one nozzle. The at least one nozzle may rotate as the pump is being actuated by a user. A rotating bezel may be provided to vary the angle of the nozzle relative to the longitudinal axis of the toy water gun.

38 Claims, 6 Drawing Sheets

TOY WATER GUN WITH VARIABLE SPRAY PATTERNS

FIELD OF THE INVENTION

The present invention relates to toy water guns, and more particularly, to a toy water gun with rotating and positionable nozzles.

BACKGROUND OF THE INVENTION

Various toy water guns have been previously described. For example, U.S. Pat. No. 5,439,139 issued to Brovelli discloses a toy water gun comprising an elongated housing, a water reservoir attached to the housing and two water pumps received in the housing. Each water pump includes a cylinder having a first end and a second end, a piston moveable along the cylinder in sealing relation to the cylinder walls, and a piston rod coupled to the piston extending out of the first end of the cylinder. An intake conduit for each water pump leads from the water reservoir to the second end of the cylinder and has a one-way intake valve that permits water to be drawn into the cylinder on an intake stroke of the piston. A discharge conduit for each water pump leads from the second end of the cylinder and includes a one-way discharge valve that permits water to be discharged from the cylinder on a delivery stroke of the piston. A nozzle is connected to each discharge conduit. An operating handle is received on the housing for movement relative to the pump cylinders and is coupled to the piston rods of both water pumps so as to simultaneously move the piston of one water pump along its delivery stroke and the piston of the water pump along its intake stroke when moved in one direction and simultaneously move the piston of the one water pump along its intake stroke and the piston of the other water pump along its delivery stroke when moved in another direction.

U.S. Pat. No. 4,651,925 issued to Harris discloses a spray device having a plurality of rotating nozzles directing sprays of a high pressure fluid in a circular pattern against an object being cleaned. The nozzles are mounted on the ends of supply pipes extending radially outward from a hub connected to a hollow crank shaft. The crank shaft is connected to a source of high pressure fluid through a supply conduit which is connected to a crank shaft by a rotary union. A small quantity of high pressure fluid is directed into a valve block from a manifold and is injected alternatively into ports of the cylinder upon pivotal movement of the cylinder to reciprocate the rod and rotate the crank shaft and connect the spray nozzles. A small quantity of diverted high pressure fluid supplies all of the power required to rotate the nozzles eliminating the need for any external power source and without materially detracting from the supply of fluid to the nozzles.

BRIEF SUMMARY OF THE INVENTION

In one aspect, the present invention is directed to a toy water gun of the type for ejecting fluid therefrom. The toy water gun may include a housing having a longitudinal axis defining a direction of fluid discharge. A reservoir may be attached to the housing for holding fluid. A holding area may be selectively in fluid communication with the reservoir through a first one-way valve. The first one-way valve may allow fluid to flow from the reservoir to the holding area when a sufficient pressure differential is generated across the first valve to open the first valve. A second one-way valve allows the fluid to flow from a holding area to an outlet port when sufficient pressure differential to open the second valve is generated.

A pump may be provided for generating a pressure differential across the first one-way valve sufficient to draw fluid from the reservoir into the holding area when the pump in actuated in a first direction. The pump may generate a pressure differential across the second one-way valve sufficient to force the fluid from the holding area into the outlet port when the pump is actuated in a second direction. At least one nozzle in fluid communication with the outlet port may be included. The at least one nozzle can be orientated at an oblique angle relative to the longitudinal axis of the housing. The at least one nozzle may be driven rotationally about the longitudinal axis of the housing when fluid is ejecting therefrom.

A bezel may be operationally connected to the housing for driving a ring cam in an axial direction in response to the rotational movement of the bezel. The ring cam may engage with the at least one nozzle to cause the nozzle trajectory angle to change in proportion to the axial movement of the ring cam. An end cap positioned on one end of the housing may have through slots formed radially therein for permitting the nozzles to project therethrough. The slots may provide a guide for the nozzle to follow as the angle of orientation varies between the ends of the slots. A shock absorbing member may be provided for receiving impact energy transmitted from the end cap and reducing the load transmitted to internal components to minimize the potential of breaking the internal components of the gun.

DETAILED DESCRIPTION OF THE INVENTION

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
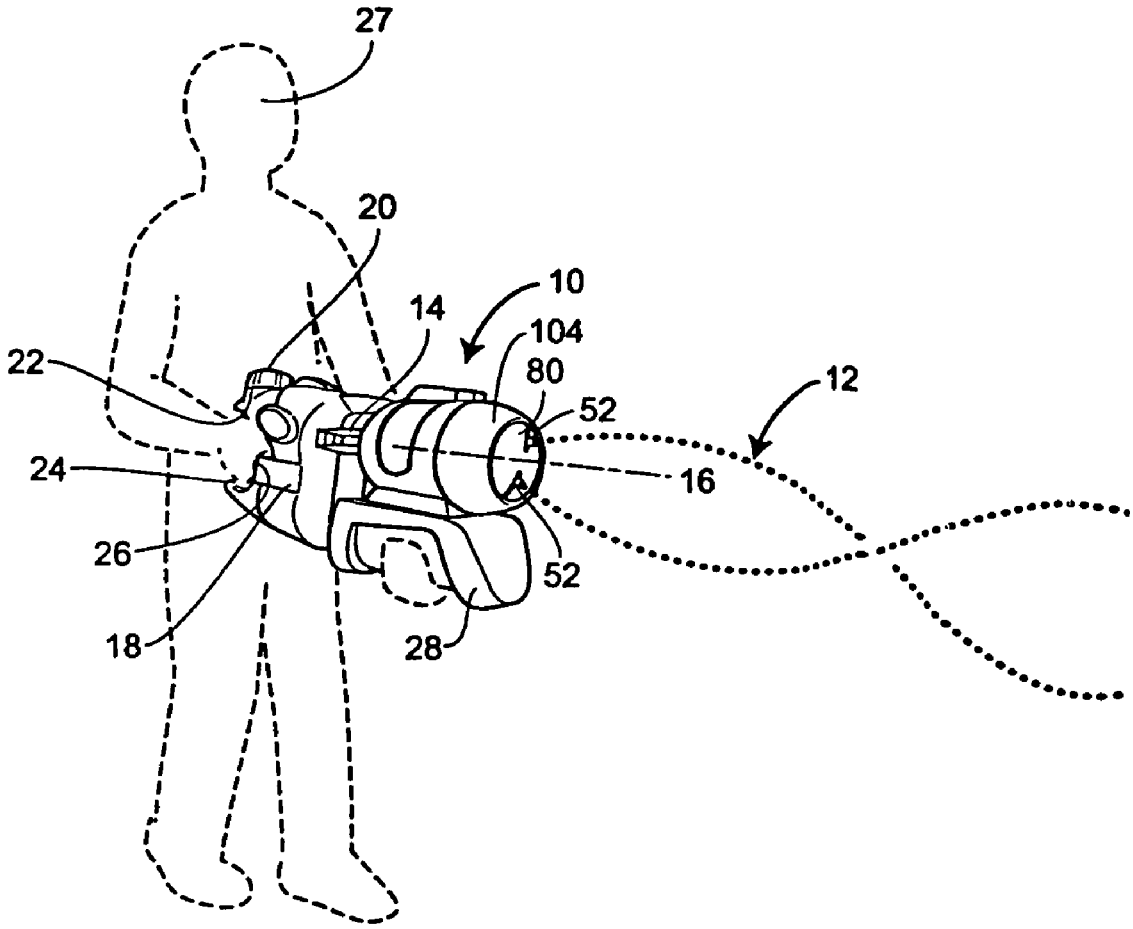
FIG. 1 is a perspective view of an individual operating a toy water gun with a helical spray pattern.

Referring to FIG. 1, a toy water gun 10 that may produce a variable spray pattern according to the present invention is illustrated therein. The toy water gun 10 is shown discharging fluid in a helical spray pattern 12. The toy water gun 10 may include a housing 14 having a longitudinal rotational axis 16 defining a direction of aim of a user 27. The toy water gun 10 may include a reservoir 18 formed integrally with the housing 14. A removable cap 20 may be provided to seal a fill port 22 after fluid has been introduced to the reservoir 18. The toy water gun 10 may include a rear handle 24 with a grip 26 for the user 27 to grasp while the user 27 is spraying the fluid from the toy water gun 10. A slide handle 28 may be provided for the user 27 to grasp and reciprocatingly actuate a pump 38 (best seen in FIGS. 2 and 3) which may be attached thereto. The pump 38 causes fluid to eject from a pair of nozzles 52 extending from the end of the toy water gun 10. As the user 27 reciprocatingly slides the handle 28 to spray fluid from the nozzles 52, a mechanism within the toy water gun 10 causes the nozzles 52 to simultaneously rotate about the axis 16, thereby causing the helical spray pattern 12. In addition to the rotational movement of the nozzles 52, the nozzle spray angle may be varied by the user 27. The user 27 may rotate a bezel 104 which mechanically actuates the nozzles 52 to vary the angle therebetween and, correspondingly vary the spray patterns between relatively narrow spray patterns and relatively wide spray patterns, as will be described in more detail below.

Figure 2:
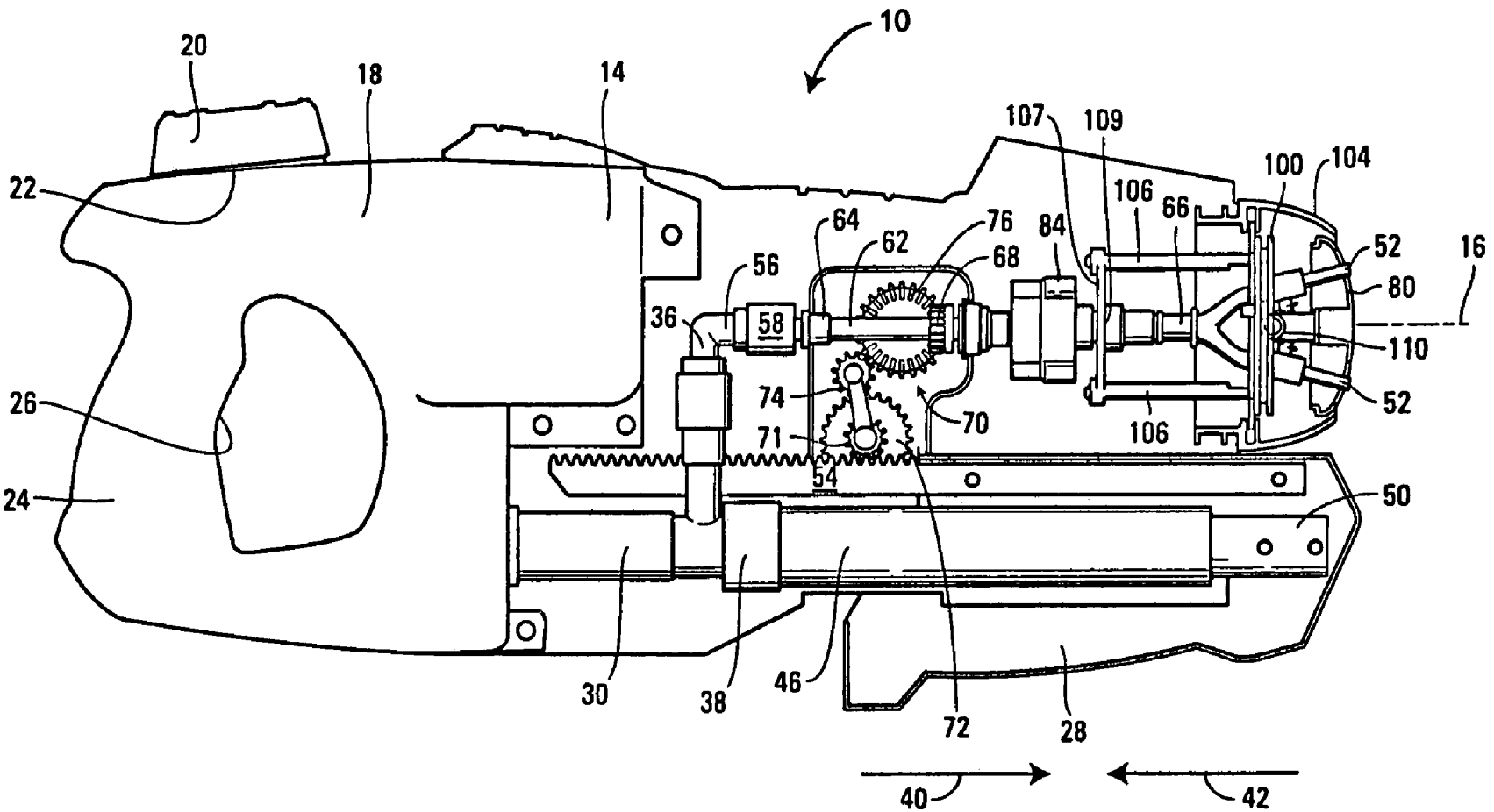
FIG. 2 is a partially cut-away side view of the toy water gun of FIG. 1.
Figures 3, 4:
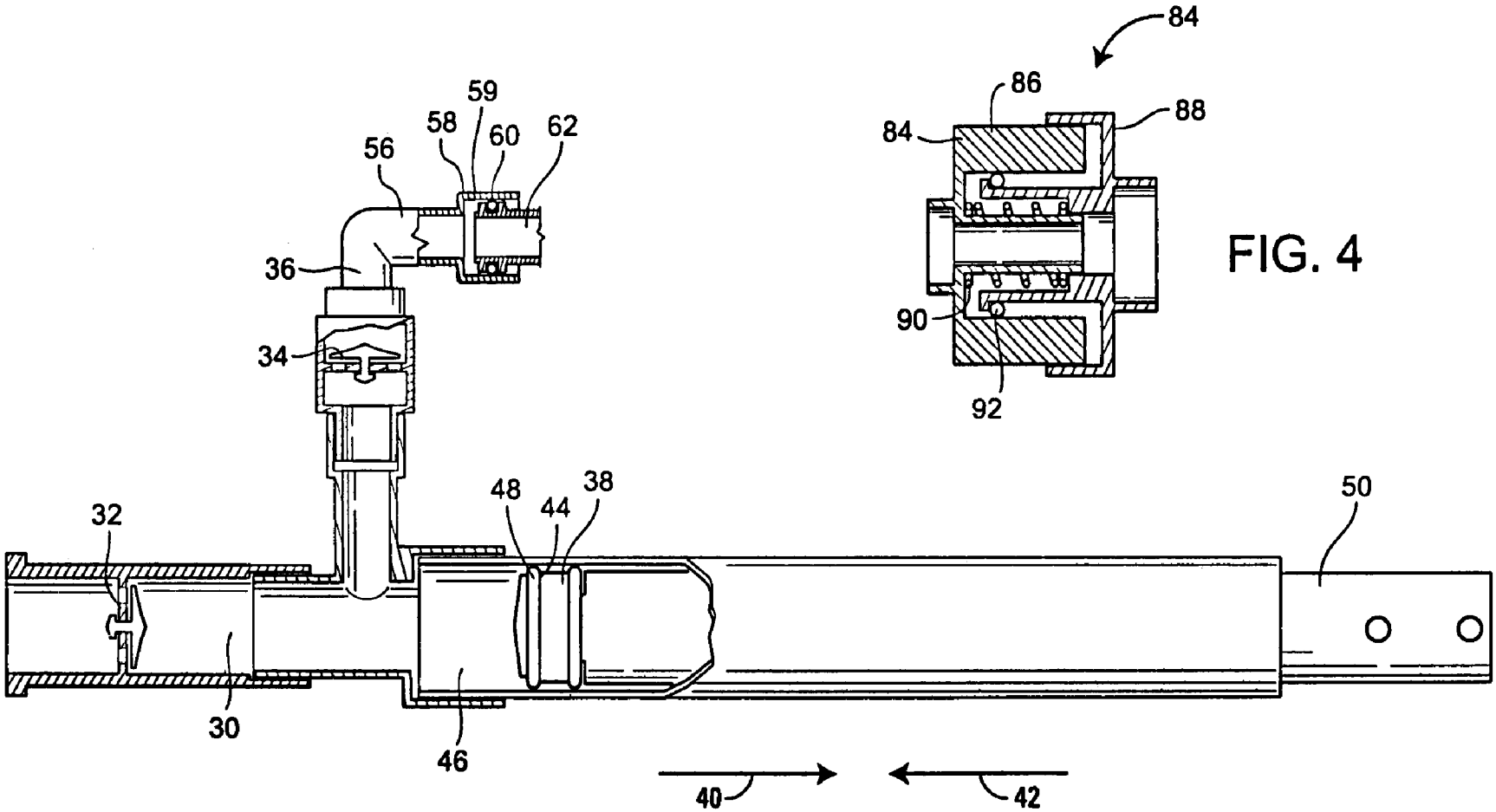
FIG. 3 is an enlarged partial cut-away view of the fluid conduits and selected components of the toy water gun of FIG. 1
FIG. 4 is a cross-sectional view of a shock absorbing member of the toy water gun of FIG. 1.

Referring now to FIG. 2, the toy water gun 10 with a portion of the housing removed is shown to more clearly illustrate the interior of the toy water gun 10 illustrated in FIG. 1. The reservoir 18 may be filled with fluid for the toy water gun 10 to spray. A holding area 30 may be in selective fluid communication with the reservoir 18. The pump 38 (best seen in FIG. 3) is operable for moving the fluid from the reservoir 18 to the holding area 30. The pump 38 may be actuated by the slide handle 28 connected to one another with a plunger 50. An outlet port 36 may be connected to the holding area 30. The pump 38 is operable for moving the fluid from the holding area 30 to the outlet port 36 as will be described more below. An outlet elbow 56 may be connected to the outlet port 36. The outlet elbow 56 may include a static-to-rotating junction 58. A rotatable outlet tube 62, having a first end 64 and a second end 66, may be mechanically connected at the first end 64 to the outlet elbow 56 at the static-to-rotating junction 58. The junction 58 places the outlet tube 62 in fluid communication with the outlet elbow 56 and may be sealed with an O-ring 60 (FIG. 3). The second end 66 of the outlet tube 62 may be fluidically coupled to the nozzles 52. The outlet tube 62 may include a shock absorbing member 84 connecting a first portion of the tube 62 proximate the first end 64 to a second portion of the tube 62 proximate the second end 66. The shock absorbing member 84 is best seen in FIG. 4 and will be described more fully below.

The toy water gun 10 may provide at least one nozzle 52 in fluid communication with the reservoir 18 through the fluid conduits described above. The nozzle 52 may be oriented at an oblique angle relative to the rotational axis 16 causing the fluid spray trajectory to substantially follow the nozzle orientation angle. It should be recognized, however, that due to the rotation of the nozzles 52, at least a portion of the fluid may be discharged at an angle to the rotational axis 16 even when the nozzles 52 may be parallel to the rotational axis 16. In one embodiment, a range of oblique nozzle angles are disclosed, but it should be understood that the nozzle 52 orientation may include any angle between 0 degrees and 180 degrees relative to the rotational axis 16. The fluid path starts at the reservoir 18 and moves through the holding area 30. The fluid then moves through the outlet port 36 to a rotating outlet tube 62. The fluid passes through a shock absorbing member 84 and out of at least one nozzle 52 extending from the outlet tube 62. In order to rotate nozzles 52 to create the helical spray pattern 12, a set of gears may operably couple the handle 28 to the outlet tube 62 as shown, or directly to the nozzles 52, to translate linear motion of handle 28 into rotational motion of the nozzles 52. A gear rack 54 may be attached to the slide handle 28 such that the gear rack 54 will move in the same direction of travel as the slide handle 28. The outlet tube 62 may include a gear 68 that is meshed with a gear train 70 and driven by the gear rack 54 attached to the slide handle 28. An outlet tube gear 68 may be connected to the outlet tube 62 at an intermediate position between the first end 64 and second end 66. The gear train 70 may include a pinion gear 71 meshed with the gear rack 54 and connected to a first gear 72. A second gear 74 may be driven by the first gear 72 and meshed with a third gear 76. The third gear 76 may be meshed with the outlet tube gear 68 such that the reciprocating motion of the gear rack 54 causes the outlet tube 62 to rotate about the rotational axis 16. While the gear rack 54 is depicted as a linear rack, the gear 54 may be designed as a spur gear or other types known to those skilled in the art. Moreover, those skilled in the art will understand that other gear configurations and drive mechanisms may be used in the toy water gun 10 to convert motion of the handle 28 into rotation of the nozzles 52.

In addition to rotating the nozzles 52 while spraying fluid, the nozzles 52 may also be actuated to change their spray angle. A bezel 104 may be rotationally connected to the housing 14 of the toy water gun 10. When the bezel 104 is rotated, a ring cam 100 operationally connected to the bezel 104 and may be operable for moving the nozzles 52 between a first position 81 and a second position 83. This is shown and described in more detail in FIGS. 5A, 5B, 6A, and 6B. A pair of guide rails 106 may slidingly connect with the housing 14 to hold the ring cam 100 in a desired position relative to the nozzles 52, or alternatively, the guide rails 106 may be fixed with respect to the housing 14 and the ring cam 100 may slidingly engage the guide rails 106. The guide rails 106 may be connected together by a cross-member 107 having an aperture 109 for the outlet tube 62 to extend therethrough. The cross-member 107 is non-rotating, but permits the outlet 62 to rotatingly engage the aperture 109. The cross-member 107 connected to the ring cam 100 may operable for sliding in a longitudinal direction along the longitudinal rotational axis 16 in response to rotation of the bezel 104.

FIG. 3 illustrates selected portions of several fluid conduits, some of which are partially cut-away. A first one-way valve 32 may be operable for allowing fluid to flow from the reservoir 18 to the holding area 30 when a pressure differential sufficient to open the first valve 32 is generated by the pump 38. A second one-way valve 34 may be operable for allowing fluid to flow from the holding area 30 to an outlet port 36 when a pressure differential sufficient to open the second valve 34 is generated by the pump 38. The pump 38 may be provided to generate a pressure differential across the first one-way valve 32 sufficient to draw fluid from the reservoir 18 into the holding area 30 when the pump 38 is actuated in a first direction depicted by arrow 40. The pump 38 may be operable for generating a pressure differential across the second one-way valve 34 sufficient to force fluid from the holding area 30 into the outlet port 36 when the pump is actuated in a second direction depicted by arrow 42. When the pump 38 is actuated in the second direction 42, the first valve 32 closes, which forces the fluid through the second valve 34. After passing through the second valve 34, the fluid enters into the outlet port 36 and may enter the static-to-rotating junction 58 formed from a non-rotatable conduit 56 that may be formed in the shape of an elbow. The rotating junction 58 may include a housing 59 for receiving the rotatable outlet tube 62. The rotatable outlet tube 62 may have a sealing member 60 such as an O-ring to seal the inner surface of the housing 59 with respect to the outlet tube 62 such that fluid will not leak from the static-to-rotating junction 58, but will allow the outlet tube 62 to rotate relative to the non-rotatable conduit 56.

The one-way valves 32, 34 are known to those skilled in the art. Any number of valve designs may work with the present invention, including, but not limited to check-ball, poppet, reed, needle and the like. The pump 38 is also known to those skilled in the art and typically includes a piston 44 in sealing engagement with a cylinder 46. The piston 44 may have at least one seal 48 such as an O ring for sealing with the internal wall of the cylinder 46 as the piston 44 reciprocatingly slides from one end of the cylinder to the other. A plunger 50 may connect the slide handle 28 (shown in FIG. 2) to the piston 44, such that as the handle 28 is moved in one direction the piston 44 will move in the same direction.

Referring now to FIG. 4, a shock absorbing member 84 may be provided to receive impact energy transmitted from the end cap 80 caused by impact loading generated by dropping the toy water gun 10 and the like. The shock absorbing member 84 may reduce the load transmitted from the end cap 80 and the nozzles 52 to internal components such as the outlet tube 62. The shock absorbing member 84 may lessen the likelihood of internal component breakage if the toy water gun 10 is inadvertently dropped or struck against a solid object. The shock absorbing member 84 may include a casing having a first element 86 and a second element 88 slidingly engaged with one another. A resilient member 90 may be positioned between the first and second elements 86, 88 of the casing for biasing element 88 away from element 86. The resilient member 90 may be operable for receiving and reducing a peak load and transmitting the reduced load through internal components of the toy water gun 10. A damping member 92 may be positioned between the first element 86 and the second element 88 of the casing and may be operable for sealing fluid internal to the first and second elements 86, 88 and for reducing oscillatory movement between the first and second elements 86, 88. The resilient member 90 may be of any design known to those skilled in the art, such as a compression spring. Likewise, the damping member 92 may be made from one of many designs known to those skilled in the art, such as an O-ring made of flexible fluid impervious material.

Figure 5A:
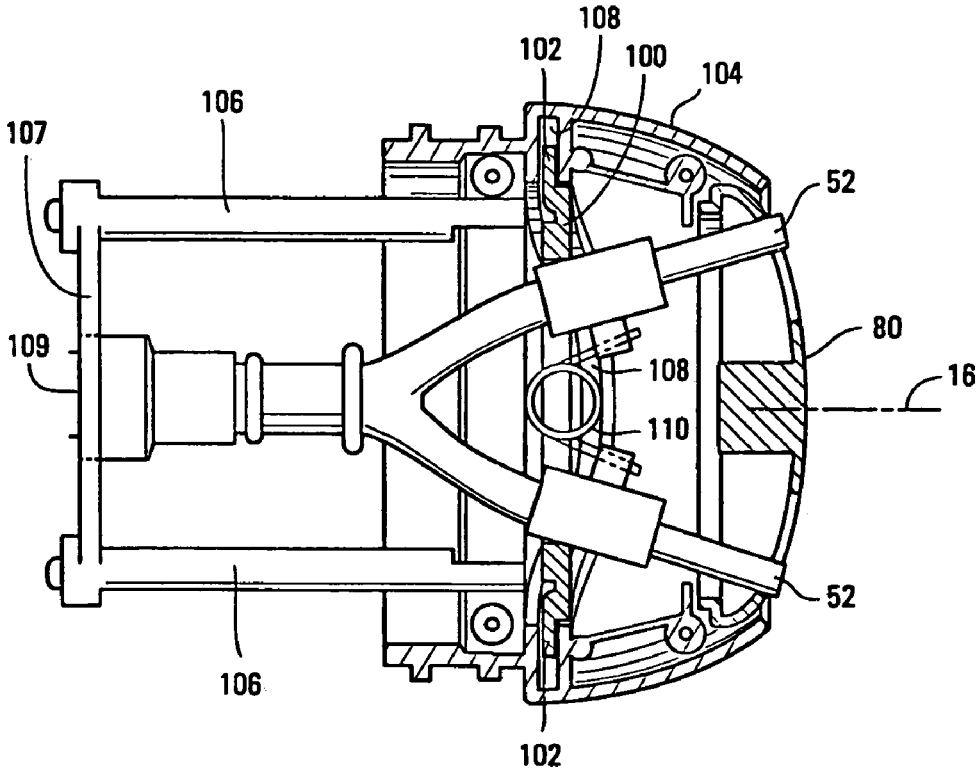
FIG. 5A is a cross-sectional view of an end portion of the toy water gun of FIG. 1 showing the nozzles in a biased first position.
Figure 5B:
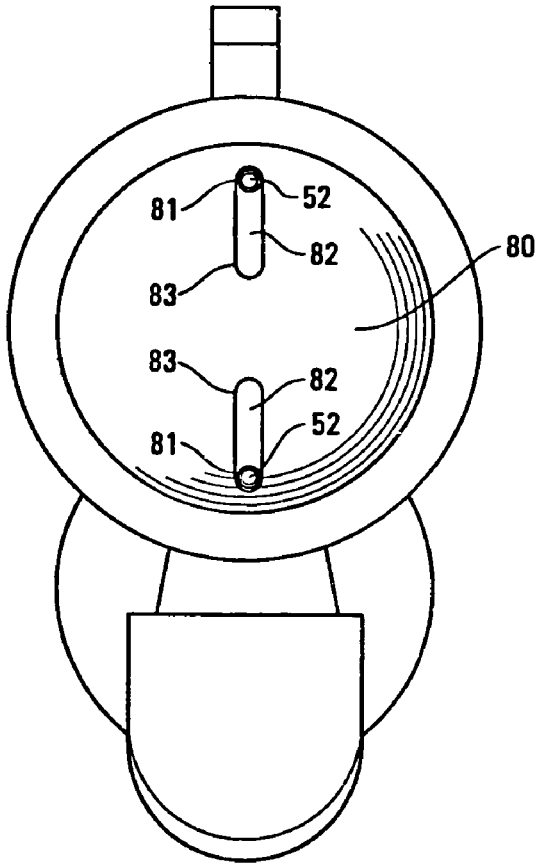
FIG. 5B is an end view of the toy water gun of FIG. 1 showing the nozzles in a biased first position.

FIGS. 5A and 5B show an enlarged view of the end portion of the toy water gun 10 with the nozzles 52 located in a first position 81. An end cap 80 positioned on one end of the housing 14 may have at least one radially extending slot 82 and, in the illustrative embodiment, at least two radially extending slots 82. The through slots 82 permit the corresponding nozzles 52 to project therethrough, and be slidable therein to permit the nozzle angle orientation relative to the longitudinal rotational axis 16 to vary between the first and second positions 81, 83 of each slot 82.

A ring cam 100 may be engageable with the nozzles 52 for varying the angle of the nozzles 52 with respect to the longitudinal axis 16. The ring cam 100 may include at least one follower pin 102 for guiding and locating the ring cam 100 with respect to the housing 14. A bezel 104 may be operationally connected to the ring cam 100 such that the ring cam 100 moves in an axial direction in response to rotational movement of the bezel 104. A pair of guide rails 106 attached to the ring cam 100 may be slidingly engageable with the housing 14 for supporting the ring cam 100 as the ring cam 100 reciprocatingly slides axially along the longitudinal axis of the housing 14. A wave groove 108 may be formed adjacent an internal surface of the bezel 104 and may have the follower pins 102 slideably disposed therein. The wave groove 108 may cause the ring cam 100 to reciprocatingly traverse along the longitudinal rotational axis 16 when the bezel 104 is rotated. The inner surface of the ring cam 100 is a fixed diameter and may engage the nozzles 52 causing the nozzles 52 to move radially inward and outward in response to the forward and aft movement of the ring cam 100. The nozzles 52 may be made, at least partially, with resilient flexible material such as rubber. A biasing member 110 may be connected to the nozzles 52 for urging the nozzles 52 radially outward from the longitudinal rotational axis 16 of the housing 14. The biasing member 110 may be designed in any manner known to those skilled in the art, but a torsional spring is depicted in the illustrated embodiment.

Figure 6A:
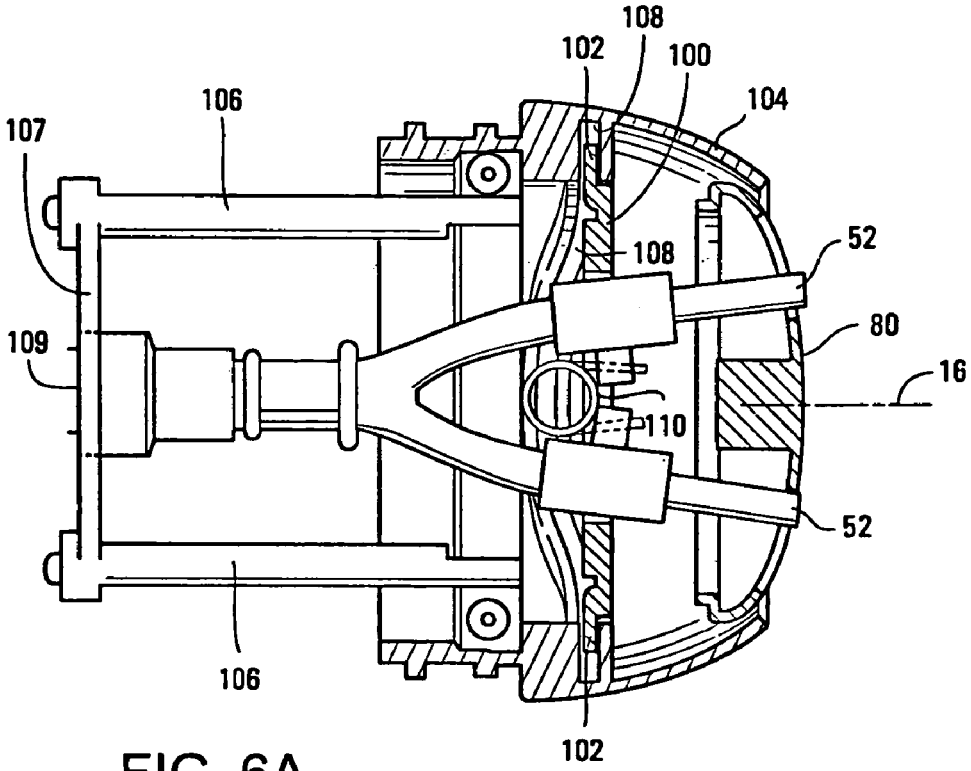
FIG. 6A is a cross-sectional view of an end portion of the toy water gun of FIG. 1 showing the nozzles in a second position.
Figure 6B:
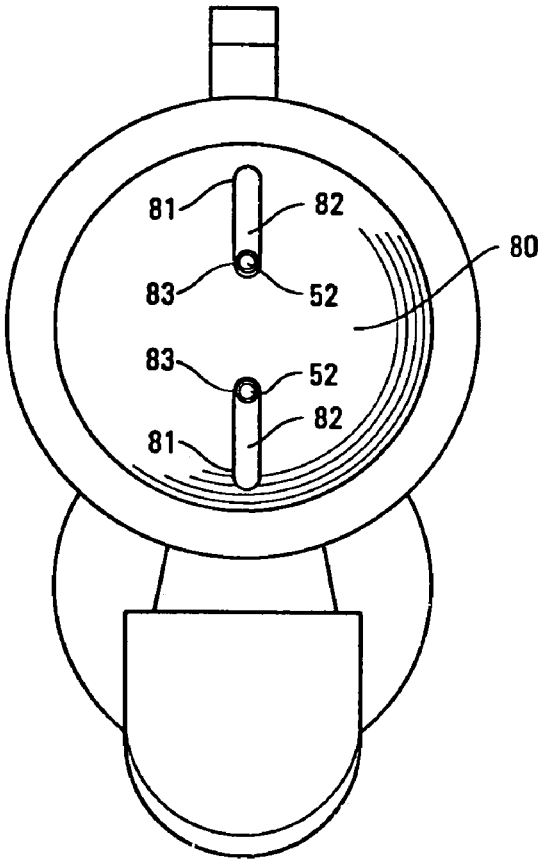
FIG. 6B is an end view of the toy water gun of FIG. 1 showing the nozzles in a second position.

Referring now to FIGS. 6A and 6B, an enlarged view of the end portion of the toy water gun 10 with the nozzles 52 located in a second position 83. The end cap 80 positioned on one end of the housing 14 may have radially extending slots 82 to permit corresponding nozzles 52 to project therethrough. The through slots 82 permit the nozzle angle orientation relative to the longitudinal axis 16 to slidingly move to the second end 83 of each slot 82. Rotating the bezel 104 causes the follower pins 102 slideably disposed in the wave groove 108 to move forward. The forward movement of the ring cam 100 overcomes the force of the biasing member 110, causing the nozzles 52 to reduce the angle of orientation relative to the rotational axis 16. The guide rails 106 attached to the ring cam 100 also moves forward to provide support to the ring cam 100 in the forward position. In an alternate embodiment the guide rails 106 may be fixed with respect to the housing 14 and the ring cam 100 my slide along the guide rails 106 for support.

Figure 7:
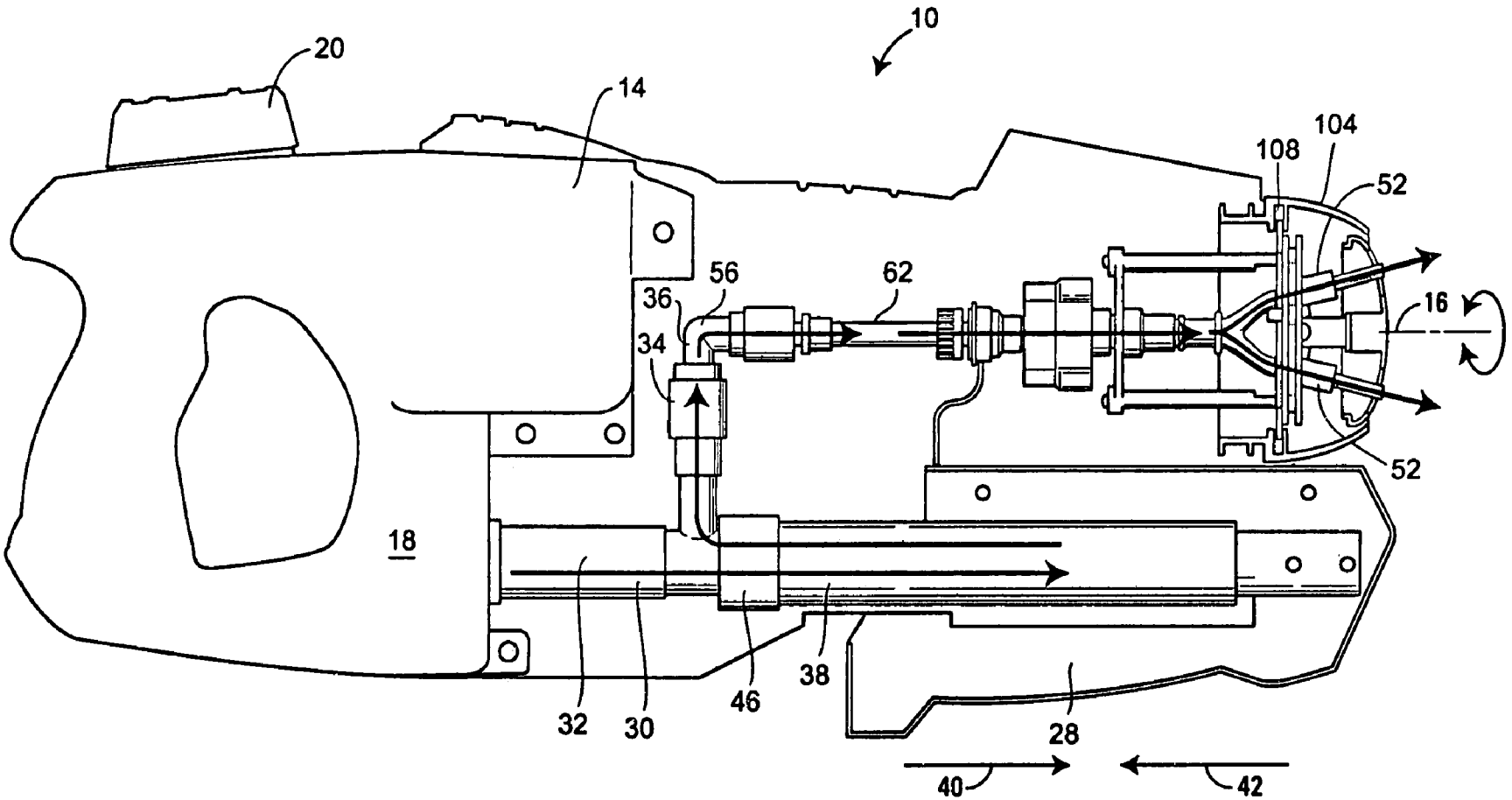
FIG. 7 is a partial cut-away side view with arrows schematically illustrating the fluid flow path through the conduits in the toy water gun of FIG. 1.

Referring now to FIG. 7, the fluid flow path of the toy water gun 10 will be described more fully. The filler cap 20 may be removed from the housing 14 and fluid (not shown)

may be poured into the reservoir 18. The fluid is prevented from leaving the reservoir 18 by a first one-way valve 32 when the valve 32 is closed. The user may grip the slide handle 28 and slide the handle 28 forward in the direction of arrow 40 causing the pump 38 to draw a vacuum in the cylinder 46. The vacuum acting on the first one-way valve 32, causes the first valve 32 to open and allow fluid to flow from the reservoir 18 into the holding area 30. The first valve 32 closes after the holding area 30 is filled with fluid. The user 27 may slide the sliding handle 28 rearward in the direction of arrow 42 to cause the pump 38 to pressurize the holding area 30 and open the second one-way valve 34. The fluid in the holding area 30 will flow past the second one-way valve 34 and into the outlet port 36. The fluid continues to traverse through the outlet elbow 56 and into the rotating outlet tube 62. The fluid then ejects out of the nozzles 52 until the end of the rearward pumping stroke and the fluid has substantially emptied from the holding area 30.

In operation, the toy water gun 10 may spray fluid in a helical pattern 12 and have variable angles of nozzle 52 trajectory. The user 27 may actuate the slide handle 28 which causes the outlet tube 62, nozzles 52, and bezel 104 to rotate while the fluid is being ejected from the toy water gun 10. The gear rack 54 may move in the same direction and magnitude as the slide handle 28. The gear rack 54 may drive the gear train 70 (best seen in FIG. 2). When the pump handle 28 is moved in the direction of arrow 40 (forward), the pinion gear 71 and first gear 72 rotates counter-clockwise, the second gear 74 rotates clockwise, and the third gear 76 rotates in a counter-clockwise direction. The third gear 76 drives the output gear 68 in a counter-clockwise direction when viewed from the front of the toy water gun 10. Likewise, when the handle 28 is moved in the direction of arrow 42 (rearward), each gear will rotate in the opposite direction relative to the forward movement of the handle 28 as described above. Moving the handle rearward in the direction of arrow 42 causes the nozzles 52 to rotate in a clockwise direction as viewed from the front of the toy water gun 10. The gear train 70 is shown to include three intermediate gears between the gear rack 54 and the output gear 68, however, as known to those skilled in the art, any number or combinations of gears can be utilized depending on the particular requirements of the application. Changing the number and size of the gears will change the speed and direction of the rotating nozzles 52 relative to the handle 28 actuation.

Also in operation, the user 27 may change the angle of the nozzles 52 relative to the rotational axis 16 by rotating the bezel 104. As described earlier, the follower pins 102 of the ring cam 100 slidingly engage with the wave groove 108 formed on the internal surface of the bezel 104. As the bezel 104 is rotated the ring cam 100 will traverse axially back and forth. The user 27 can change the angle of the nozzles 52 anywhere between the first and second positions 81, 83. The rotating nozzles 52 cause the fluid spray pattern to form a helical shape as depicted in FIG. 1. Changing the angle of orientation of the nozzles 52 with the bezel 104 changes the shape of the helical spray pattern 12 from a narrow to a wide helix pattern. While this disclosure includes an embodiment wherein the pump 38 is used to directly force fluid out of the nozzles 52, it should be understood that a rotating nozzle configuration can be used with a toy water gun having a pressurized air chamber for causing fluid to discharge from the nozzles 52 as is known to those skilled in the art. The pump may be used to pressurize a chamber such that when a trigger is pulled, the air pressure is released which forces the fluid to discharge from the nozzles. The nozzles may be rotated simultaneously with a slide handle or the like while fluid is discharging therefrom.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A toy water gun of the type for ejecting fluid therefrom, the toy water gun comprising:

a housing;

a reservoir attached to the housing for holding fluid;

a holding area formed by conduits selectively in fluid communication with the reservoir;

a pump for generating a suction force to draw fluid from the reservoir into the holding area when the pump is actuated in a first direction toward a first position and for generating a pressure force to move the fluid from the holding area into an outlet port when the pump is actuated in a second direction toward a second position; and at least one nozzle in fluid communication with the holding area, the at least one nozzle oriented at an angle with respect to a longitudinal rotational axis of the nozzle, and the at least one nozzle driven rotationally about the longitudinal axis in response to movement of the pump in the second direction.

2. The toy water gun of claim 1, wherein the pump comprises:

piston operable for inducing fluid flow through pressure and suction forces;

a cylinder in fluid communication with the holding area and operable for providing a sealing path for the piston to reciprocate therein;

a first one-way valve for allowing fluid to flow from the reservoir to the holding area when a sufficient pressure differential to open the first valve is generated by the pump; and a second one-way valve for allowing fluid to flow from the holding area to an outlet port when a sufficient pressure differential to open the second valve is generated by the pump.

3. The toy water gun of claim 2 further comprising:

a slide handle connected to the piston for permitting manual actuation of the pump.

4. The toy water gun of claim 2 further comprising:

a non-rotatable conduit connected to the outlet port on one end and forming a static-to-rotating junction on the other end, the static-to-rotating junction adapted to prevent fluid leakage therefrom; and a rotatable outlet tube connected between the non-rotatable conduit and the at least one nozzle, placing the nozzle in fluid communication with the non-rotatable conduit.

5. The toy water gun of claim 4 further comprising:

an outlet tube gear attached to the outlet tube adapted to rotationally couple with the pump.

6. The toy water gun of claim 5 further comprising:

a gear train coupled between the pump and the outlet tube operable for converting the reciprocating motion of the pump into rotational motion of the outlet tube.

7. The toy water gun of claim 6, wherein the gear train comprises:

a gear rack attached to the slide handle;

a first gear meshed to and driven by the gear rack;

a second gear coupled to and driven by the first gear;

a third gear meshed to and driven by the second gear; and a fourth gear meshed to and driven by the third gear, the fourth gear coupled to the output gear for rotatably driving the output tube.

8. The toy water gun of claim 4, wherein the static-to-rotating junction comprises:

a fluid seal engageable with sealing surfaces located on the rotatable outlet tube and the non-rotatable conduit.

9. The toy water gun of claim 1 further comprising:

a ring cam engaging the at least one nozzle whereby the angle of the nozzle with respect to the longitudinal axis decreases when the ring cam moves in a first cam direction and the nozzle angle increases when the ring cam moves in a second cam direction.

10. The toy water gun of claim 9, wherein the ring cam further comprises:

at least one follower pin formed on the ring cam for guiding the ring cam; and at least one guide rail attached to the ring cam for slidingly engaging the housing and supporting the ring cam through a range of axial locations.

11. The toy water gun of claim 9 further comprising:

a bezel mounted on the housing proximate the nozzle, the bezel operably connected to the ring cam such that the ring cam moves parallel to the longitudinal axis between a first position and a second position in response to rotational movement of the bezel.

12. The toy water gun of claim 11, wherein the bezel further comprises:

a wave groove formed therein for the at least one follower pin to slidingly engage therewith, the wave groove causing the ring cam to reciprocatingly traverse along the longitudinal axis between the first and second positions.

13. The toy water gun of claim 1 further comprising:

an end cap positioned on one end of the housing having at least one radially extending through slot for permitting at least one nozzle to slidingly engage therewith.

14. The toy water gun of claim 1 further comprising:

a shock absorbing member having first and second elements, the elements being operable for rotating together and for slidably moving in an axial direction with respect to one another.

15. The toy water gun of claim 14, wherein the shock absorbing member comprises:

a casing formed by the first and second elements;

a resilient member positioned in the casing adapted to compress when an impact force is transmitted from the nozzle; and a damping member positioned in the casing adapted to permit movement between the first and second elements and to prevent fluid leakage from the casing.

16. The toy water gun of claim 1, wherein the at least one nozzle is at least partially made of resilient flexible material.

17. The toy water gun of claim 1 further comprising:

a biasing member connected to the at least one nozzle for urging the at least one nozzle radially outward from the longitudinal axis.

18. A toy water gun comprising:

a housing;

a reservoir attached to the housing for holding fluid;

a holding area formed by conduits selectively in fluid communication with the reservoir;

a pump for generating a suction force to draw fluid from the reservoir into the holding area when the pump is actuated in a first direction toward a first position and for generating a pressure force to move the fluid from the holding area into an outlet port when the pump is actuated in a second direction toward a second position; and at least one nozzle in fluid communication with the holding area, the at least one nozzle oriented at an angle with respect to a longitudinal rotational axis of the nozzle, and the at least one nozzle driven rotationally about the longitudinal axis in response to movement of the pump in the second direction;

a first one-way valve for allowing fluid to flow from the reservoir to the holding area when a sufficient pressure differential to open the first valve is generated by the pump;

a second one-way valve for allowing fluid to flow from the holding area to an outlet port when a sufficient pressure differential to open the second valve is generated by the pump; and a shock absorbing member coupled to the nozzle, the shock absorbing member adapted to attenuate an impact force transmitted from the at least one nozzle.

19. The toy water gun of claim 18, wherein the pump comprises:

piston operable for inducing fluid flow through pressure and suction forces;

a cylinder in fluid communication with the holding area and operable for providing a sealing path for the piston to reciprocate therein; and a slide handle connected to the piston for permitting manual actuation of the pump.

20. The toy water gun of claim 18 further comprising:

a non-rotatable conduit connected to the outlet port on one end and forming a static-to-rotating junction on the other end, the static-to-rotating junction adapted to prevent fluid leakage therefrom;

a rotatable outlet tube connected between the non-rotatable conduit and the at least one nozzle, placing the nozzle in fluid communication with the non-rotatable conduit; and an outlet tube gear attached to the outlet tube adapted to rotationally couple with the pump.

21. The toy water gun of claim 20, wherein the static-to-rotating junction comprises:

a fluid seal engageable with sealing surfaces formed on the rotatable outlet tube and the non-rotatable conduit.

22. The toy water gun of claim 20 further comprising:

a gear train coupled between the pump and the outlet tube operable for converting the reciprocating motion of the pump into rotational motion of the outlet tube.

23. The toy water gun of claim 22, wherein the gear train comprises:

a gear rack attached to the slide handle;

a first gear meshed to and driven by the gear rack;

a second gear coupled to and driven by the first gear;

a third gear meshed to and driven by the second gear; and a fourth gear meshed to and driven by the third gear, the fourth gear coupled to the output gear for rotatably driving the output tube.

24. The toy water gun of claim 18 further comprising:

an end cap positioned on one end of the housing, the end cap having at least one radially extending through slot for permitting a nozzle to project therethrough, the slot permitting the nozzle angle of orientation to vary between a predetermined range of angles defined relative to the longitudinal axis.

25. The toy water gun of claim 18, wherein the shock absorbing member comprises:

a casing formed by the first and second elements;

a resilient member positioned in the casing adapted to compress when an impact force is transmitted from the nozzle; and a damping member positioned in the casing adapted to permit movement between the first and second elements and to prevent fluid leakage.

26. The toy water gun of claim 25, wherein the resilient member is a helical spring and the damping member is an O-ring made of flexible fluid impervious material.

27. The toy water gun of claim 18 further comprising:

a ring cam engaging the at least one nozzle whereby the angle of the nozzle with respect to the longitudinal axis decreases when the ring cam moves in a first cam direction and the nozzle angle increases when the ring cam moves in a second cam direction;

at least one follower pin formed on the ring cam for guiding the ring cam; and at least one guide rail attached to the ring cam for slidingly engaging the housing and supporting the ring cam through a range of axial locations.

28. The toy water gun of claim 27 further comprising:

a bezel operationally connected to the ring cam for reciprocatingly moving the ring cam in response rotational movement of the bezel.

29. The toy water gun of claim 28, wherein the bezel further comprises:

a wave groove formed therein for the at least one follower pin to slidingly engage therewith, the wave groove causing the ring cam to reciprocatingly traverse along the longitudinal axis between the forward and aft positions.

30. The toy water gun of claim 18 further comprising:

a biasing member connected to the at least one nozzle for urging the at least one nozzle radially outward from the longitudinal axis of the housing.

31. A method for ejecting fluid from rotating nozzles of a toy water gun, comprising:

actuating a handle connected to a pump;

converting motion of the pump into rotational motion of the nozzles; and ejecting fluid from the rotating nozzle.

32. The method of claim 31, wherein the rotating step comprises:

driving at least one gear in response to the pump actuation.

33. The method of claim 31, wherein the actuating step comprises:

manually moving a pump handle connected with the pump for producing a compression stroke in one direction and a suction stroke in an opposing direction.

34. A method for ejecting fluid from rotating nozzles of a toy water gun, comprising:

providing nozzles moveable between first and second angles;

providing a nozzle engagement member moveable between first and second positions;

engaging the nozzles with the engagement member;

moving the nozzles to the first angle when the engagement member moves to the first position;

moving the nozzles to the second angle when the engagement member moves to the second position;

providing a pump discharge mechanism for discharging fluid from a reservoir through the nozzles when actuated; and providing a drive mechanism causing the nozzles to rotate when the discharge mechanism is actuated.

35. In a toy water gun for discharging a stream of water through a nozzle, the water gun having a rotational axis, the improvement comprising:

the nozzle being rotatable relative to the rotational axis and being operative for discharging the stream of water at an angle relative to the axis, the water gun further comprising a manually operable mechanism operatively coupled to the nozzle for rotating the nozzle relative to the axis.

36. The toy water gun of claim 35, further comprising:

a manual pump for pressurizing a chamber and causing water to discharge from the nozzle, the pump coupled to and moveable with the manually operable mechanism.

37. In a toy water gun for discharging a stream of water through at least one nozzle spaced outwardly from a rotational axis, the improvement comprising:

the nozzle being rotatable relative to the rotational axis and being operative for discharging the stream of water, the water gun further comprising a manually operable mechanism operatively coupled to the nozzle for rotating the nozzle relative to the axis.

38. The toy water gun of claim 37, further comprising:

a manual pump for pressurizing a chamber and causing water to discharge from the nozzle, the pump coupled to and moveable with the manually operable mechanism.

* * * * *